US005557809A

United States Patent [19]

Adams

[11] Patent Number: 5,557,809

[45] Date of Patent: Sep. 24, 1996

[54] TOILET SEAT COVER

[76] Inventor: James L. Adams, 37 Fremont Dr., Fargo, N. Dak. 58103

[21] Appl. No.: 394,773

[22] Filed: Feb. 27, 1995

Related U.S. Application Data

[63] Continuation-in-part of Ser. No. 148,296, Nov. 8, 1993, Pat. No. 5,392,469, and a continuation-in-part of Ser. No. 15,141, Nov. 9, 1993, Pat. No. Des. 356,634.

[51] Int. Cl.[6] ..... A47K 13/14; A47K 13/18

[52] U.S. Cl. ..... 4/245.3; 4/245.4; 4/245.6; 4/245.8; 4/245.9

[58] Field of Search ..... 4/245.1, 245.2, 4/245.3, 245.4, 245.6, 245.7, 245.8, 245.9

[56] References Cited

U.S. PATENT DOCUMENTS

| | | |
|---|---|---|
| 1,077,277 | 11/1913 | Holmes . |
| 1,108,460 | 8/1914 | Mesick et al. . |
| 1,761,391 | 6/1930 | Harris . |
| 2,093,168 | 9/1937 | Hamer . |
| 2,302,317 | 11/1942 | Henry . |
| 2,312,589 | 3/1943 | Reeves . |
| 4,806,406 | 2/1989 | Akerman et al. . |
| 4,875,242 | 10/1989 | Albrecht et al. . |
| 4,935,969 | 6/1990 | Farnsworth . |
| 4,975,990 | 12/1990 | Chan . |
| 5,107,549 | 4/1992 | Pitts et al. . |

FOREIGN PATENT DOCUMENTS

| | | | |
|---|---|---|---|
| 194250 | 9/1986 | European Pat. Off. | 4/245.8 |
| 2631225A | 11/1989 | France . | |
| 416033 | 7/1925 | Germany . | |
| 1913444 | 10/1970 | Germany | 4/245.3 |
| 1387994 | 3/1975 | United Kingdom . | |
| 1600786 | 10/1981 | United Kingdom . | |
| 2182688 | 5/1987 | United Kingdom . | |
| 2263488 | 7/1993 | United Kingdom | 4/245.8 |

*Primary Examiner*—Henry J. Recla
*Assistant Examiner*—Charles R. Eloshway
*Attorney, Agent, or Firm*—Burd, Bartz & Gutenkauf

[57] ABSTRACT

A cover for a toilet seat is a plurality of plastic sheet members having side, front and rear sections surrounding an opening aligned with a toilet seat opening when the cover is placed on the toilet seat to protect a person from contaminants, side members are attached to opposite sides of the sheet members and extend downwardly adjacent opposite sides of the toilet seat. An apron, attached to the front of the sheet members, extends downwardly in front of the toilet seat and bowl to shield a person's legs and clothing from the toilet seat and bowl. An internal flap releasably connected to the sheet members is adapted to extend downwardly into the toilet bowl adjacent the front of the inside of the toilet seat. The sheet members are made of water-soluble material that dissolves at temperatures in a high range. The side members and apron are made of water-soluble material that dissolves at temperatures in a low range.

18 Claims, 3 Drawing Sheets

TOILET SEAT COVER

CROSS REFERENCE: TO RELATED APPLICATIONS

This application is a continuation-in-part of U.S. application Ser. No. 08/148,296, filed Nov. 8, 1993 now U.S. Pat. No. 5,392,469 and CIP of U.S. application Ser. No. 29/015,141, filed Nov. 9, 1993 now U.S. Pat. No. Des. 356,634.

FIELD OF THE INVENTION

The invention is in the art of protective covers for structures that are normally engaged with a part of a person's body to shield the body from foreign materials, liquids, solids and contaminants that may be on the structures. The protective cover is a cover for a toilet seat used to shield a person from contaminants such as bacteria, viruses and parasites that may be on the toilet seat.

BACKGROUND OF THE INVENTION

Sanitary protection products are used by humans to protect the person's body from being contaminated with foreign materials and contaminants; that may be hazardous to health. Protective clothing, gloves; and shields are worn by a person to guard against contaminants, particulates and foreign materials that may be present in the environment in which the person works and lives. The necessities of life expose persons away from home to contaminants when using public rest rooms and the toilets therein. Paper seat covers have been developed for use with conventional toilet seats to insulate a person from the foreign materials and contaminants thereon. L. N. Albrecht and S. R. Burke show in U.S. Pat. No. 4,875,242 a paper toilet seat cover. These covers are generally flat oval-shaped paper products that are adapted to rest on top of the toilet seats. The paper toilet seat covers do not have structures that have flaps and aprons to shield body parts from the inside and outside of the toilet seat and bowl thereby exposing the person directly to the foreign materials and contaminants on the seat and bowl. The seat cover, after use, must be disposed of in a sanitary and environmentally safe manner.

SUMMARY OF THE INVENTION

The invention relates to protective covers for structures having openings usable as human body supports to shield the body from foreign matter and contaminants located on and adjacent the structures. The cover has flexible and foldable sheet members, such as plastic sheet members having opposite side sections joined to base sections, all of which surround a generally central opening, A front apron is joined to the front of the base sections of the sheet members. A flap, spaced inwardly from the apron, is joined to the sheet members. In use, the apron extends downwardly in front of the structure, the side sections extend downwardly adjacent opposite sides of the structure, and the flap extends downwardly into the opening of the structure to shield a person's body and clothing from the structure to prevent contamination of the person. Retaining structures, such as an adhesive, secured to the sheet material are releasably attached to the sheet members to hold the sheet members on the structures. The base sections of the sheet members are made of materials, warm or hot water-soluble plastic film, that are hot water-soluble at a first selected temperature range. The side sections and apron are made of materials, such as cold water-soluble plastic film, that are cold water-soluble at a second selected temperature range that is below the first selected temperature range. The material that dissolves at the second temperature range is disposed of in normal water temperatures. This reduces the solid volume of the cover, as only the base sections remain. The base sections dissolve in warm and hot water.

The preferred embodiment of the seat cover of the invention is used with a toilet seat having a front portion and side members joined to the back section and a generally central opening between the side members to accommodate the lower body and legs of a human in a seated position. The cover comprises sheet material that is of a size to cover the toilet seat and opposite sides and front of the toilet bowl to shield the person using the toilet seat and the person's clothing.

The sheet material has a base that rests on top of the toilet seat. The base has a first section for covering one side of the toilet seat and a second section for covering the other side of the toilet seat. The base is made of material that is warm or hot water-soluble at temperatures between 45 to 130 degrees F. An example of this material is LA20 polyvinyl hot water-soluble film. The first and second sections of the base are secured together with a strip of plastic. Side sheet members are attached to the outsides of the first and second sections and an apron is attached to the front of the base. The side sheet members extend downwardly adjacent opposite sides of the toilet seat and bowl. The apron extends downwardly adjacent the front of the toilet seat and bowl. The side sheet members and apron are shields that prevent direct contact of a person's body and clothing with the toilet seat and bowl. The side sheet members and apron are made of material that is cold water-soluble at temperatures between 34 to 55 degrees F. An example of this material is LA20 polyvinyl cold water-soluble film. The base also has a rearwardly-directed flap having opposite sides that are releasably connected to the first and second sections of the base. When the flap is released from the first and second sections, it can be folded down into the bowl opening adjacent the inside of the front of the toilet seat to prevent body contact with the toilet seat and direct liquids down into the bowl. All of the materials of the cover are water-soluble to allow disposal of the cover in the toilet water. The side members and apron dissolve in the cold water in a short period of time. The base is of a size that it can flow with the toilet water and dissolve when the water temperature elevates. Alternatively, the person can dissolve the base in hot water.

The seat covers for the toilet seat are low cost, disposable compact shields that can be carried in pockets or purses for suitable protection when needed. The cover is preferably made of plastic materials, such as cold and warm water-soluble polyethylene films. Other types of materials, including papers and biodegradable plastics, can be used for the covers.

DESCRIPTION OF THE PREFERRED EMBODIMENT

Figure 1:
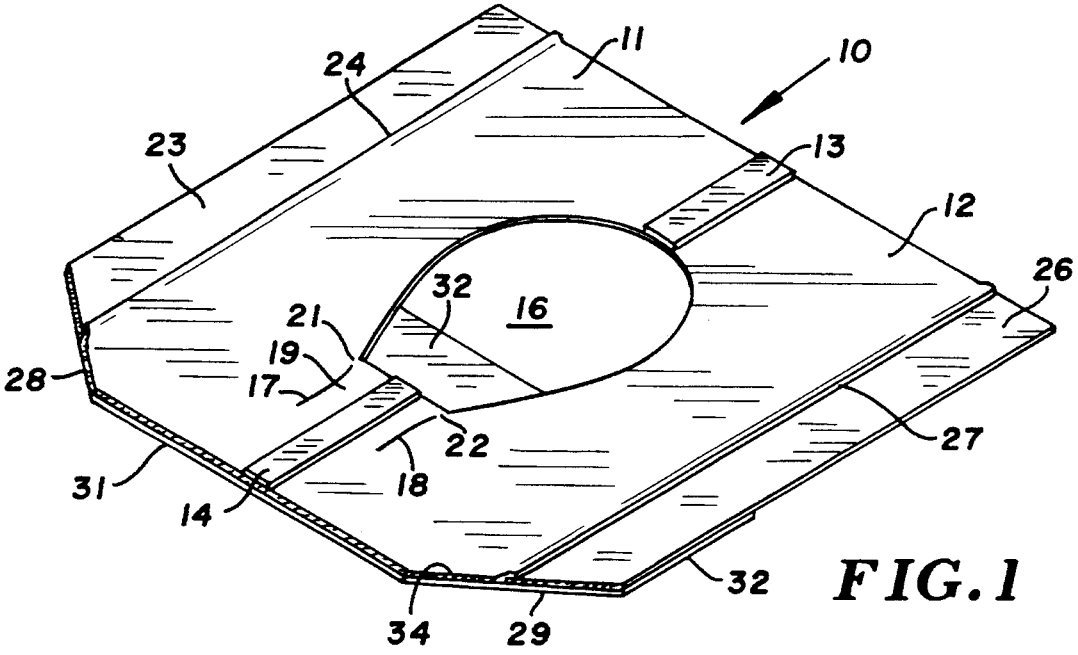
FIG. 1 is a perspective view of the cover for a toilet seat of the invention.
Figure 2:
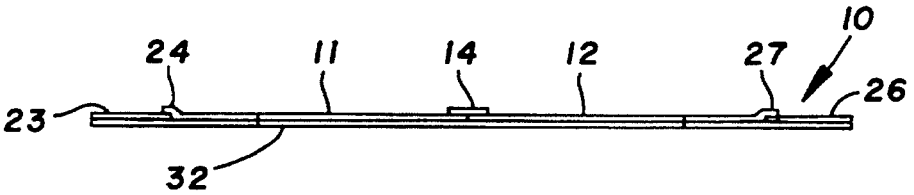
FIG. 2 is a front elevational view thereof.
Figure 3:
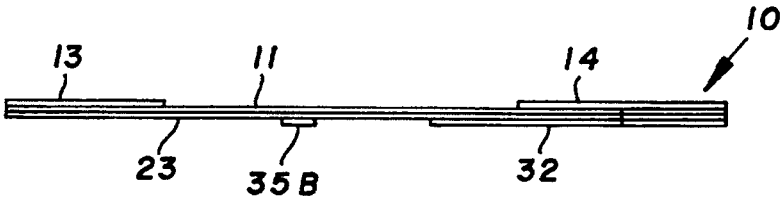
FIG. 3 is a side elevational view thereof.
Figure 4:
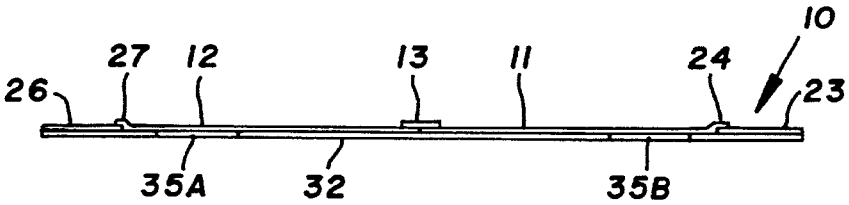
FIG. 4 is a rear elevational view thereof.
Figure 5:
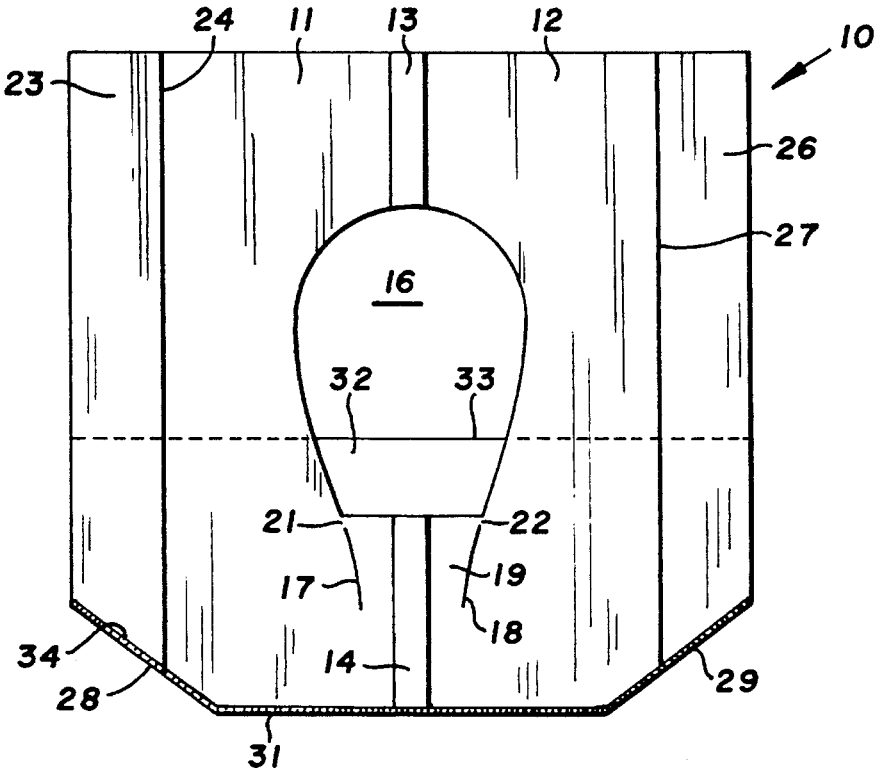
FIG. 5 is a top plan view thereof.

Referring to FIGS. 1–6 of the drawings, there is shown a cover, indicated generally at 10, for a toilet seat. Cover 10 is a disposable sheet member made of water-soluble materials which will dissolve in water at selected temperatures. Cover 10 comprises a base having a pair of sheet members 11 and 12 having adjacent edges secured together with strips 13 and 14 to form a body of the cover that rests on top of a conventional toilet seat. The joined sheet members 11 and 12 have a general ovaloid central opening 16. The front portion of sheet members 11 and 12 have generally longitudinal slits 17 and 18 forming a generally rectangular flap 19. The rear portions of flap 19 are joined to sheet members 11 and 12 with connecting portions 21 and 22 which maintain flap 19 in general alignment with sheet members 11 and 12 during storage. Connecting portions 21 and 22 are separated from adjacent portions of sheet members 11 and 12 to allow flap 19 to extend downwardly into a toilet bowl adjacent the front of the toilet seat.

A first longitudinal side member 23 is joined to the outside edge of sheet member 11 with a heat seal seam 24. A second side member 26 is joined to the outside edge of sheet member 12 with a heat seal seam 27. Sheet member 11 and side member 23 have a champered or angled corner 28. A similar champered or angled corner 29 is located at the forward ends of sheet member 12 and side member 26. Sheet members 11 and 12 have a transverse linear front edge 31.

Figure 6:
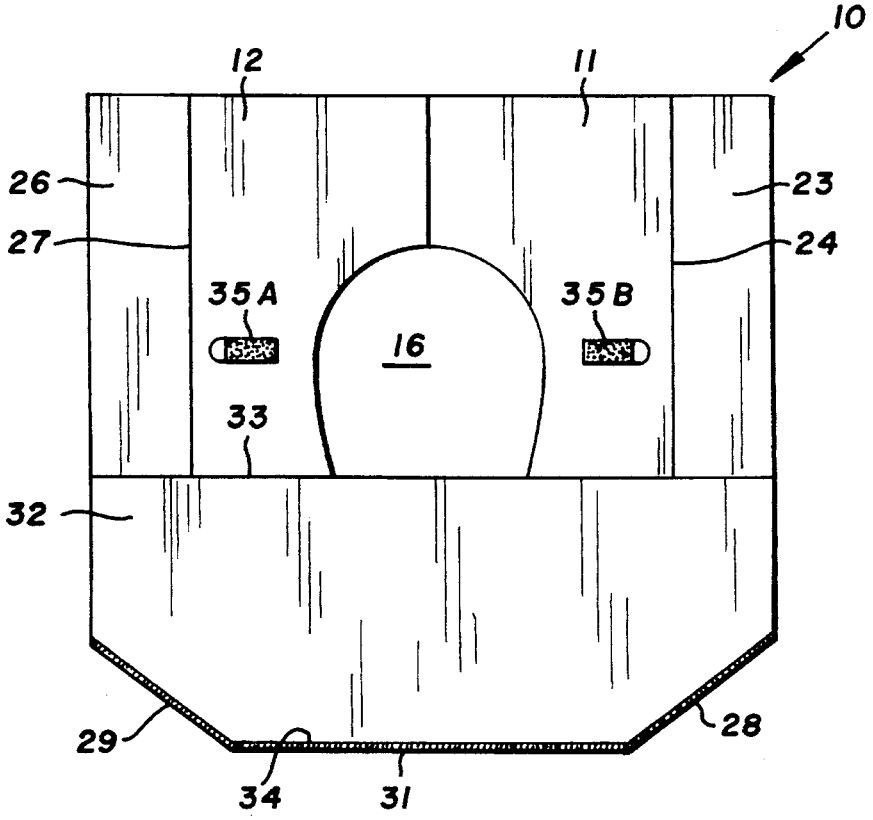
FIG. 6 is a bottom plan view thereof.

As seen in FIG. 6, an apron 32 is joined to the corners 28 and 29, and front edge 31 with a heat seam 34. Apron 32 extends rearwardly from the front edge beyond flap 19 and covers the forward portion of opening 16 when in the flat or storage position. In use, apron 32 is a downwardly-directed shield that provides a barrier to prevent a person's legs and clothing from engaging the toilet seat and bowl. Side members 23 and 24, connecting strips 13 and 14, and apron 32 are cold water-soluable sheets, such as cold water-soluable plastic film. An example of a cold water-soluable material is a LA polyvinyl cold water-soluable film. When placed in cold water, the side members 23 and 24, and apron 32 dissolve leaving only the base. The base separates into two parts after connecting strips 13 and 14 dissolve. The base will dissolve in warm or hot water so that the entire cover is disposable in water. The base, being relatively small, is carried by the toilet water to waste treatment installations where is dissolves.

The bottom surfaces of sheet members 11 and 12 have adhesive patches 35A and 35B used to releasably secure sheet members 11 and 12 to the top surface of a toilet seat. Cover plastic strips (not shown) are used to protect the adhesive during storage. The cover strips are removed from the adhesive before cover 10 is located on the toilet seat. The top surface of sheet members 11 and 12 are coated with a moisture-absorbent body powder to reduce adherence of the sheet members to a person's body.

Figure 7:
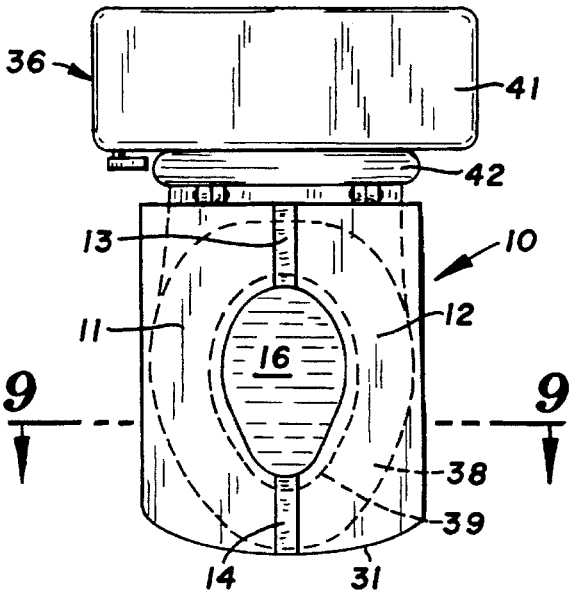
FIG. 7 is a top plan view of the cover located on a toilet seat.
Figure 9:
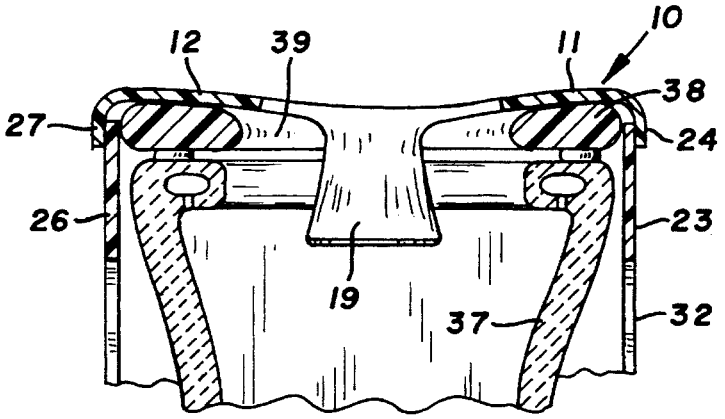
FIG. 9 is a sectional view taken along the line 9—9 of FIG. 7.

Referring to FIGS. 7 and 9, there is shown a conventional toilet or water closet, indicated generally at 36, having a bowl 37 supporting a conventional toilet seat 38. Seat 38 has an elongated opening 39 which is located forwardly of a water tank 41. A conventional lid 42 is hinged to bowl 37 to selectively open and close opening 39 of the toilet seat and cover the top of the toilet seat.

Figure 8:
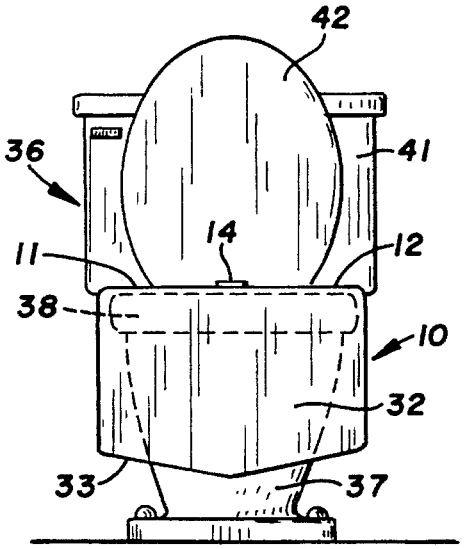
FIG. 8 is a front elevational view of FIG. 7.

In use, cover 10 is unfolded and placed on top of the toilet seat 38. The uncovered adhesive strips 35A and 35B are located in surface engagement with opposite portions of seat 38 to locate and hold cover 10 on the seat. The opening 16 of cover 10 is located in vertical alignment with the opening of the toilet seat. Opening 16 is smaller than the toilet seat opening so that inside portions of sheet members 11 and 12 extend inwardly of the inside of the toilet seat. This shields the person's body from the inside of the toilet seat. The flap 19 is folded down into the bowl, as seen in FIG. 9, after its outer edges have been released from connecting portions 21 and 22. The side members 23 and 26 drape downwardly adjacent opposite sides of seat 38 and bowl 37. Apron 32 folds over the front of seat 38 and covers the forward portion of seat 38 and bowl 37, as seen in FIG. 8. Apron 32 has a vertical length about twice the vertical length of flap 19, as seen in FIG. 9. Side members 23 and 26 extend downwardly adjacent opposite sides of seat 38 and bowl 37. Apron 32 draped down in front of seat 38 and bowl 37. Flap 19 extends down into bowl 37 adjacent the inside of seat 38 and bowl 37. Side members 23 and 26, apron 32 and flap 19 provide barriers which shield a person's body and clothes from contacting or engaging the seat and bowl thus protecting the person's body from being contaminated by liquids, solids and contaminants on the seat and bowl.

Sheet members 11 and 12 are low-density plastic that are water-soluble at temperatures above 45 degrees F. Preferably, the material of sheet members 11 and 12 is warm or hot water-soluble at temperatures between 45 and 130 degrees F. The connecting strips 13 and 14, side members 23 and 26, and apron 32 are plastic sheets made of material that are water-soluble in cold water at temperatures between 34 and 55 degrees F. An example of the materials of cover 10 are as follows: sheet members 11 and 12 are in a LA 20 polyvinyl hot water-soluble 1 mil film. Strips 13 and 14, side members 23 and 26, and apron 32 is in a LA 60 poly vinyl hot water-soluble 1 mil film.

After a person has used the toilet, cover 10 is removed from seat 38 and disposed of in water, such as the water in the toilet bowl. The cold water-soluable material quickly dissolves side members 23 and 27, apron 32 and strips 13 and 14 in the water. Side sections 11 and 12 are separated from each other when strips 13 and 14 dissolve. This enhances the flow of side sections 11 and 12 with the toilet water. Warm water at the waste disposal plant dissolves side sections 13 and 14. Cover 10 is used as a shield to insulate the body, legs and other body parts, as well as clothing of a person from contaminants and foreign materials that are found on toilet seat 38 and adjacent structures. The contaminants can include liquids, solids, bacteria, viruses, fungi, parasites and like germs and organisms that can be a health or even a death hazzard. Cover 10 can be made from plastic film or treated papers. Cover 10 can be used with all types of toilet seats and other structures to provide a barrier between the body of a person and the structure accommodating the cover.

While there has been shown and described a preferred embodiment of the seat cover of the invention for use with a conventional toilet seat, it is understood that changes in the structure, materials, shape of the cover and the use of the cover may be made by those skilled in the art without departing from the invention. The invention is defined in the following claims.

I claim:

1. A cover for a toilet seat having a front portion, side members joined to a back section and a generally central opening between the side members to accommodate the lower body and legs of a human comprising: sheet means for covering the toilet seat to protect the person using the toilet seat, said sheet means having a first section for covering one side member of the toilet seat, a second section-for covering the other side member of the toilet seat, said first and second sections comprising sheet material being water-soluble only at temperatures above 100 degrees F, strip means securing the first and second sections together with an opening between said first and second sections, said strip means comprising material being water-soluble only at temperatures above 34 degrees F, a first side sheet member secured to the first section, a second side sheet member secured to the second section, and an apron secured to the first and second sections and the first and second side sheet members and adapted to extend downwardly from the front portion of the toilet seat, said first and second side sheet members and apron comprising material being water-soluble only at temperatures above 34 degrees F.

2. The cover of claim 1, wherein: said first and second sections form a rearwardly-directed flap, said flap having opposite side releasably connected to the first and second sections, said opposite sides of the flap being releasable from the first and second sections such that the flap extends downward into a toilet bowl when the cover is placed on a toilet seat.

3. The cover of claim 2 wherein: said flap has a first portion joined to the first section and a second portion joined to the second section of the sheet means, and connecting means securing the first portion to the second portion of the flap to said first and second sections, said connecting means comprising material being water-soluble only temperatures above 34 degrees F.

4. The cover of claim 1 wherein: said sheet means has a rearwardly-directed flap, said apron has a length greater than the length of the flap.

5. The cover of claim 1 wherein: said sheet means has a rearwardly-directed flap, said apron has a width greater than the width of the flap.

6. The cover of claim 1 wherein: said sheet means has a rearwardly-directed flap, said apron has a length and width greater than the length and width of the flap.

7. A cover for a toilet seat having a front portion, side members joined to a back section and a generally central opening between the side members to accommodate the lower body and legs of a human comprising: sheet means for covering the toilet seat to protect the person using the toilet seat, said sheet means having opposite sides and a generally central opening smaller than the central opening of the toilet seat, said sheet means comprising material being water-soluble only at temperatures above 100 degrees F, a first side sheet member secured to a first side of the sheet means, a second side sheet member secured to a second opposite side of the sheet means, and an apron secured to the sheet means and adapted to extend downwardly from the front portion of the toilet seat, said first and second side members and apron comprising material being water-soluble only at temperatures above 34 degrees F.

8. The cover of claim 7 wherein: said sheet means has a rearwardly-directed flap, said flap having opposite sides releasably connected to the sheet means, said opposite sides of the flap being releasable from the sheet means such that the flap extends downward into a toilet bowl when the cover is placed on the toilet seat.

9. The cover of claim 8 wherein: said sheet means has a first section and a second section, said flap has a first portion joined to the first section and a second portion joined to the second section of the sheet means, and connecting means securing the first portion to the second portion of the flap, said connecting means comprising material being water-soluble only at temperatures above 34 degrees F.

10. The cover of claim 7 wherein: said sheet means has a rearwardly-directed flap, said apron has a length greater than the length of the flap.

11. The cover of claim 7 wherein: said sheet means has a rearwardly-directed flap, said apron has a width greater than the width of the flap.

12. The cover of claim 7 wherein: said sheet means has a rearwardly-directed flap, said apron has a length and width greater than the length and width of the flap.

13. A cover for a toilet seat having a front portion, side members joined to a back section and a generally central opening between the side members to accommodate the lower body and legs of a human comprising: sheet means for covering the toilet seat to protect the person using the toilet seat, said sheet means having opposite sides and a generally central opening smaller than the central opening of the toilet seat, said sheet means comprising material being hot water-soluble at a selected first temperature range, a first side sheet member secured to a first side of the sheet means, a second side sheet member secured to a second opposite side of the sheet means, and an apron secured to the sheet means and adapted to extend downwardly from the front of the toilet seat, said first and second side members and apron comprising material being water-soluble at a second temperature range entirely lower than the first temperature range.

14. The cover of claim 13 wherein: said sheet means has a rearwardly-directed flap, said flap having opposite sides releasably connected to the sheet means, said opposite sides of the flap being releasable from the sheet means such that the flap extends downward into a toilet bowl when the cover is placed on a toilet seat.

15. The cover of claim 14 wherein: said sheet means has a first section and a second section, said flap has a first portion joined to the first section and a second portion joined to the second section of the sheet means, and connecting means securing the first portion to the second portion of the flap, said connecting means comprising material being water-soluble at said second temperature range.

16. The cover of claim 13 wherein: said sheet means has a rearwardly-directed flap, said apron has a length greater than the length of the flap.

17. The cover of claim 13 wherein: said sheet means has a rearwardly-directed flap, said apron has a width greater than the width of the flap.

18. The cover of claim 13 wherein: said sheet means has a rearwardly-directed flap, said apron has a length and width greater than the length and width of the flap.

* * * * *